United States Patent [19]

Tsai

[11] Patent Number: 4,886,472

[45] Date of Patent: Dec. 12, 1989

[54] PUSH-TYPE WIRE TERMINATING APPARATUS

[76] Inventor: Jing-Hwang Tsai, No. 25, Lane 729, Chung-Cheng S. Road, Yung-Kang Hsiang, Tainan Hsien, Taiwan

[21] Appl. No.: 217,003

[22] Filed: Jul. 8, 1988

[51] Int. Cl.[4] ..... H01R 13/06

[52] U.S. Cl. ..... 439/656

[58] Field of Search ..... 439/656

[56] References Cited

U.S. PATENT DOCUMENTS 4,397,518 8/1983 Tsai ..... 439/656

*Primary Examiner*—Joseph H. McGlynn

*Attorney, Agent, or Firm*—Townsend and Townsend

[57] ABSTRACT

An improved push-type wire terminating apparatus having an outer casing formed with a plurality of wire grooves, a first recess in a middle portion, a hollow section in an upper portion, and a pair of metal conductors, each having a wire guide opening in the upper end, fixed in the hollow section with a lower portion of each metal conductor extending out of the outer casing. The improvement includes a pressing member having a plurality of wire passages and an open section formed therein movably installed in the hollow section with an upper portion elastically extending out of the top end of the outer casing, and a sliding member with a plurality of wire guide channels and side legs loosely arranged in the open section of the pressing member, so that when the pressing member is depressed, a maximum clearance will be attained between the pressing member and the sliding member for the purpose of facilitating wire strand insertion operations, and when the pressing member is moved up, the maximum clearance will be reduced to zero, firmly securing the wire strands in the outer casing.

3 Claims, 6 Drawing Sheets

(B)

(A)

(D)

(C)

PRIOR A

PUSH-TYPE WIRE TERMINATING APPARATUS

BACKGROUND OF THE INVENTION

This invention relates to an improved push-type wire terminating apparatus by which wire connections can be conveniently made through mechanical pressing actions.

Although wire terminating apparatus has been widely used, the present variety of known wire terminating apparatus seldom satisfies the requirements of safe and convenient use. In order to improve the prior art in this respect, the applicant has made great efforts to develop a push-type wire terminating apparatus. Example of prior push-type wire terminating apparatus is as shown in FIG. 1 (A, B, C, D) which was patented on Aug. 9, 1983 under U.S. Pat. No. 4,397,518. The product of this patent has earned a popular esteem since it became available in the market.

In the above-mentioned prior art, the structure generally includes an outer casing A with a hollow section, a movable body C with two wire passages C1 loosely disposed in the hollow section of the outer casing A through a spring B, and a pair of conductors D each with a wire guide hole in the upper portion separately fixed in the outer casing A as shown in FIG. 1(A). When the movable body C is pressed down, as shown in FIG. 1(B), the wire passages C1 of the movable body C will be aligned with the wire through holes D1 of the conductors D so as to allow the electrical wires to pass through and effect a connection. When the pressure applied on the movable body C is released, an elastic force from the spring B will push the movable body C upward, and the electrical wires will be secured in the wire guide hole D1 of the conductors D as shown in FIG. 1(C). Therefore, this simplified safe and convenient push-type wire terminating apparatus has earned a good reputation and is widely demanded in the market. However, as there are a great variety of specifications for current electrical cores covering many uses, further improvement of the push-type wire terminating apparatus has to be made accordingly. The fact is that, if the wire strands of the electrical cord is small, they can be easily inserted into the wire passages C1 and passed through the wire guide holes D1. Whereas, if the electrical cord and the wire strands thereof are large, the insertion and passing of the electrical cord and wire strands through both the wire passages C1 and the wire guide holes D1 will be difficult, thus, resulting in possible loose connections and poor contacts. In this case, both the wire passages C1 and the wire through holes D1 have to be enlarged as shown in FIG. 1(D). However, since the vertical distance L defined by two wire-press points in the movable body C is limited, the wire passages C1 and wire guide holes D1 cannot be enlarged enough to satisfy the requirements of large electrical cords. The preferable way to solve this problem is to have both wire-press points located at the same level so that the vertical distance L equals zero (L=0). However, a greater vertical distance L will enable better wire insertion. As a result, a technical breakthrough for overcoming the above contradiction has to be realized.

SUMMARY OF THIS INVENTION

It is accordingly a primary object of the present invention to provide an improved push-type wire terminating apparatus that overcomes the foregoing problems associated with the prior art.

This and other objects are achieved by providing an improved push-type wire terminating apparatus having an outer casing formed with a hollow section therein, a first recess in the middle, a pair of wire grooves (one opposite the other) in the hollow section, at least two metal conductors, each having a wire guide opening formed in the upper portion, fixed in the hollow section with the lower portion of each metal conductor protruding out of the outer casing, which apparatus comprises: a pressing member having at least two wire passages formed therein and a stop edge provided on the upper back side, an open section in the lower portion, â pair of wire bending blocks at the lower side, and a second recess in the lower end movably disposed in the hollow section of the outer casing with the upper portion of the pressing member extending out of the top end of the outer casing, the second recess being aligned with the first recess of the outer casing; a U-shaped sliding means having a plurality of oblique openings provided at the upper opposing sides thereof, being inversely disposed in the open section of the pressing member; and a resilient means installed in the recess of the outer casing and the second recess of the pressing member; in this way, wire terminating operations can be conveniently completed without regard to the specifications of electrical cords.

Other advantages and characteristic of the present invention will become apparent from the following detailed description of a preferred embodiment when read in conjunction with the accompanying drawings.

DETAILED DESCRIPTION OF THE PREFERRED EMBODIMENT

Figure 1:
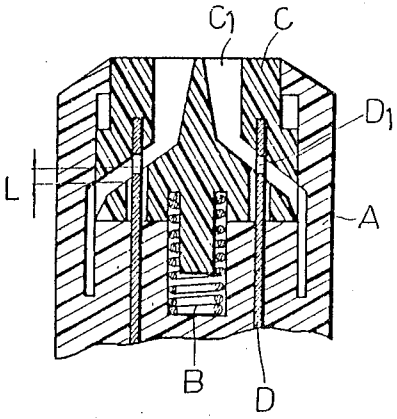
FIG.1 (PRIOR ART)
FIGS. 1(A), 1(B), 1(C) and 1(D) are sectional views of a known push-type wire terminating apparatus.
Figure 1:
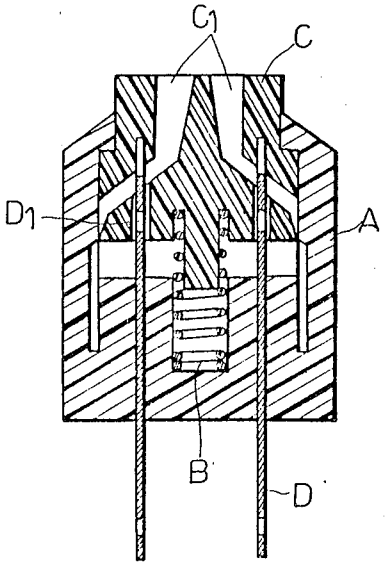
FIG.1 (PRIOR ART)
Figure 1:
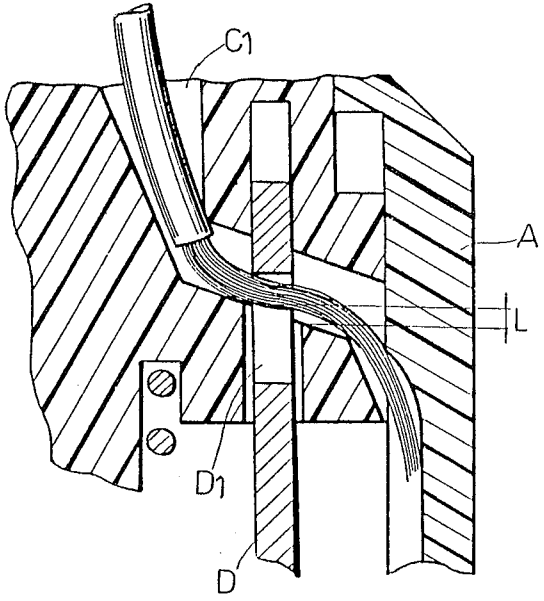
FIG.1 (PRIOR ART)
Figure 1:
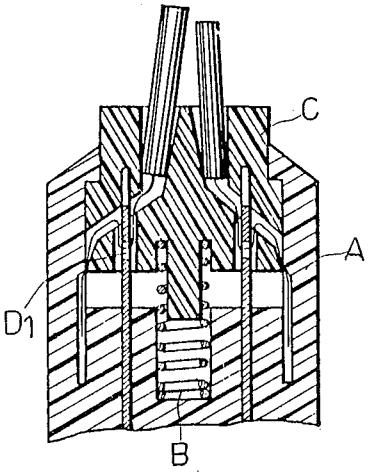
Figure 2:
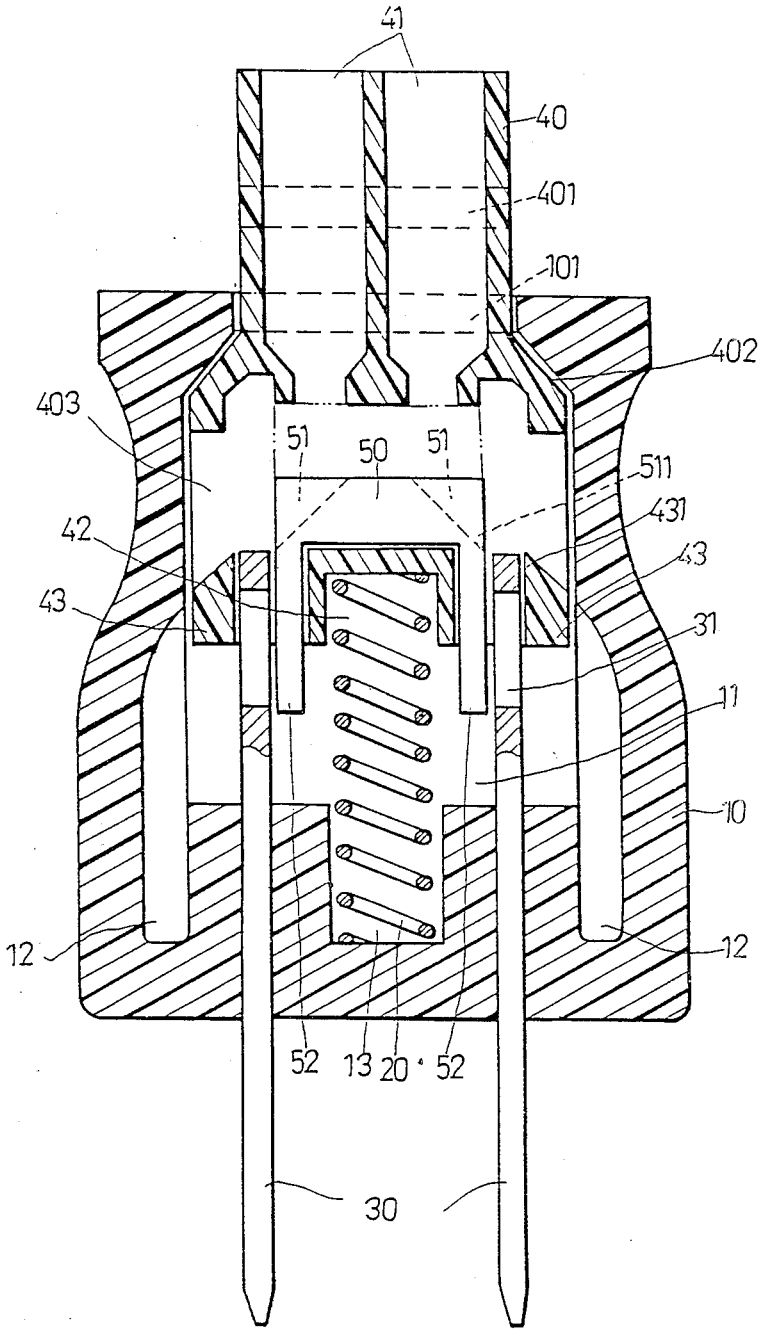
FIG. 2 is a sectional perspective view of a preferred embodiment of an improved push-type wire terminating apparatus according to this invention.
Figure 4:
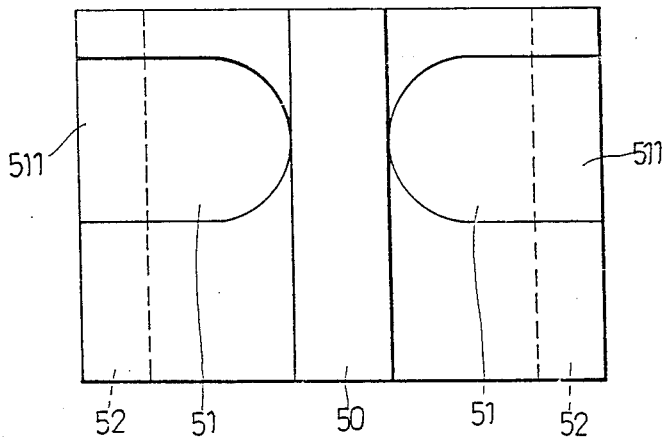
FIG. 4 is a top view of the sliding means shown in FIG. 3.
Figure 3:
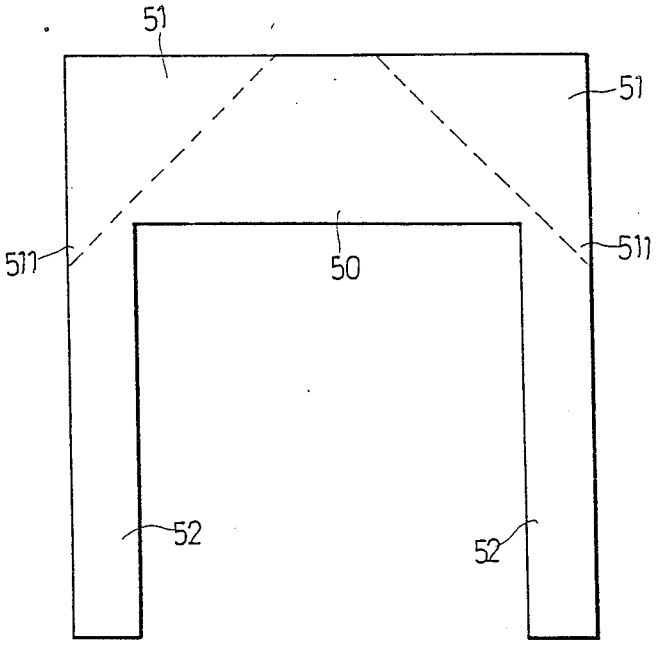
FIG. 3 is a front view of a sliding means arranged in the preferred embodiment of FIG. 2.

Referring to FIGS. 2, 3 and 4, the preferred embodiment of an improved push-type wire terminating apparatus according to this invention comprises: an outer casing 10 formed in a conventional pattern and having a hollow section 11 therein, at least two wire grooves 12 provided in the opposing sides of the hollow section 11 and extending downward therefrom, a first recess 13 in the middle area, a resilient element 20 disposed in the first recess 13, and at least two metal conductors 30 the upper end of each having a wire guide opening formed therein, fixedly provided in the hollow section 11 with each lower portion of the metal conductors 30 firmly protruding out of the outer casing 10; a pressing member 40 having at least two wire passages 41 formed in the upper portion, a stop edge 401 horizontally provided on the upper back side, a shoulder 402 located around the lower portion, an open section 403 formed therein below the shoulder 402, a pair of wire-bending blocks 43, each with a wire bending point 431, separately provided at the lower portion and vertically located in the open section 403 with the wire-bending points 431 projecting upward against the upper portion of each metal conductor 30, and a second recess 42 corresponding to the first recess 13, located at a middle lower end of the pressing member 40 which is movably installed in the hollow section 11 of the outer casing 10 with the upper portion of the pressing member 40 elastically extending out of the top side of the outer casing 10; and a U-shaped sliding member 50 having a pair of oblique guide channels 51 separately provided in the upper portion thereof and inversely disposed in the opening section 403 of the pressing member 40 over the second recess 42 wherein each oblique guide channel 51 has a wire pressing point 511 formed at the lower end of each of the oblique guide channels 51 ad located close to the upper portion of each metal conductor 30, and two side legs 52 each with a predetermined length, respectively extend downward between the opposing sides of the second recess 42 and the upper portions of the two metal conductors 30, leaving a clearance between the end of each side leg 52 and the bottom side of the hollow section 11 of the outer casing 10. It is to be noted that the provision of the two oblique guide channels 51 in the sliding member 50, as shown in FIGS. 3 and 4, forms a wire pressing point 511 at each lower side thereof. The effect of these two wire pressing points 511 will be described in the following paragraphs.

Figure 5:
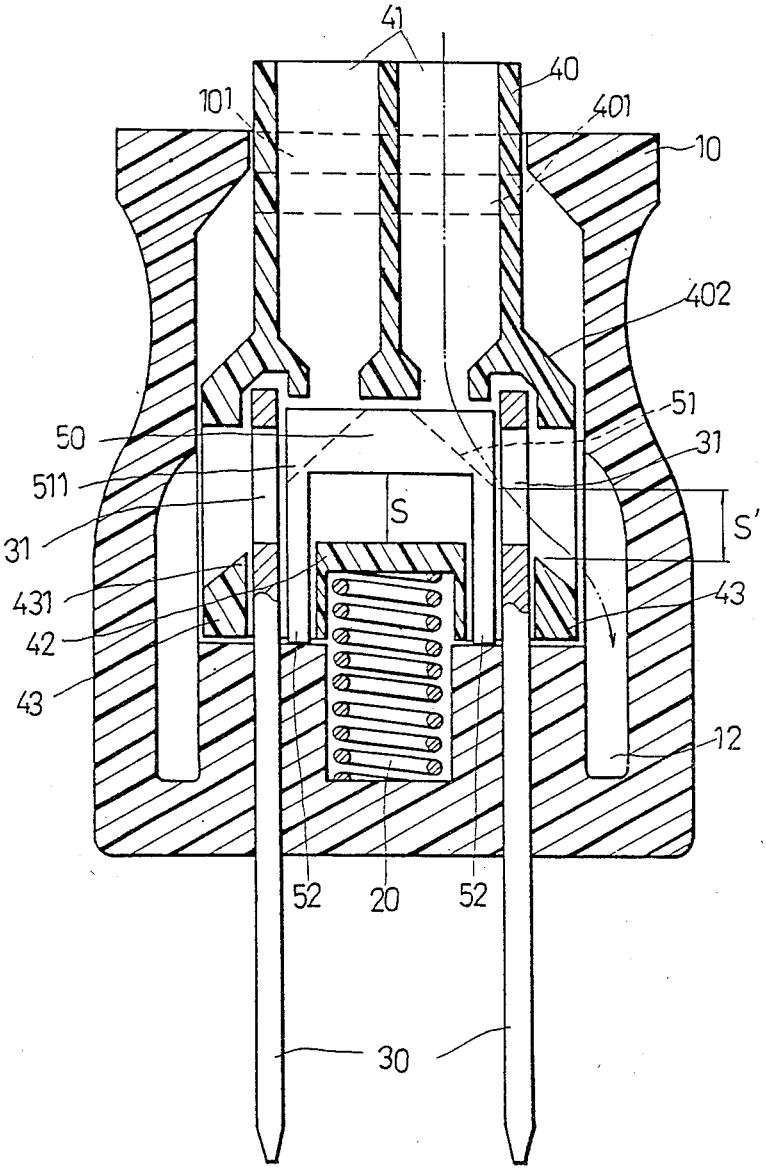
FIG. 5 is a sectional illustrative view of the preferred embodiment indicating the pressing member in a depressed position for the making of electrical wire terminations.
Figure 6:
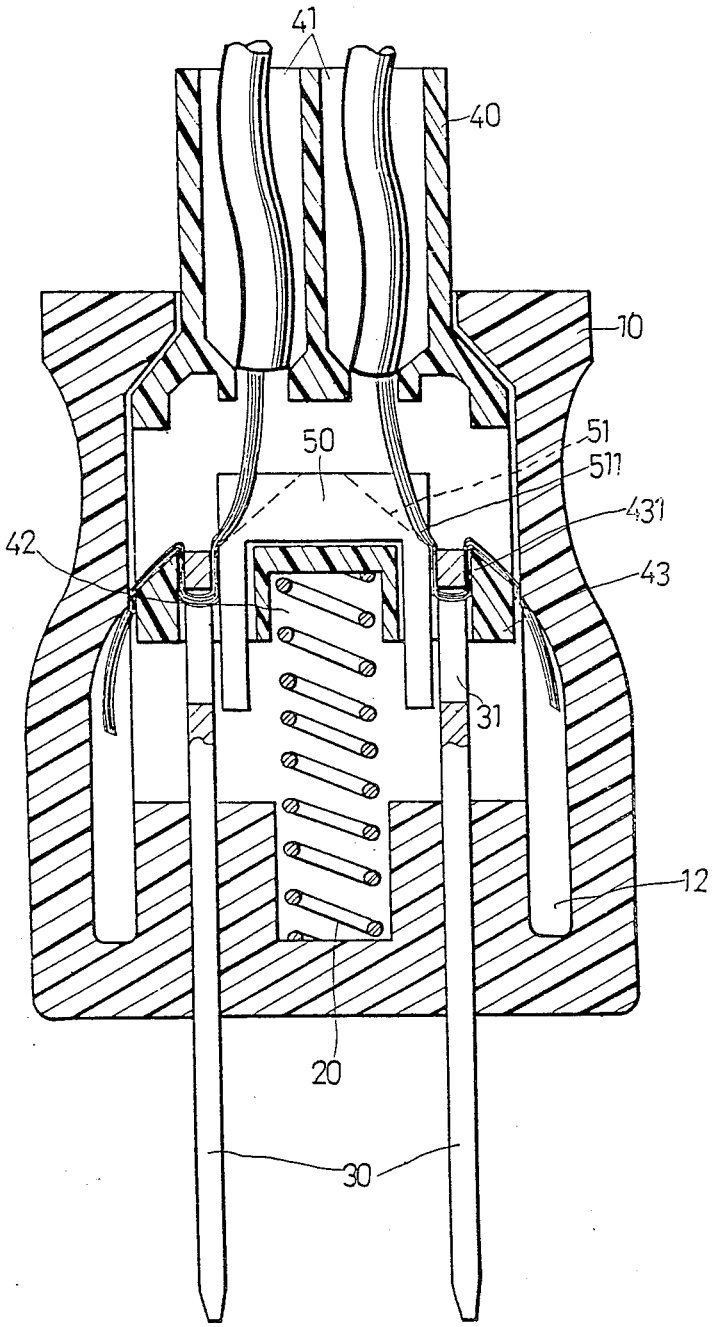
FIG. 6 is a sectional illustrative view of the preferred embodiment indicating the completed electrical wire termination.

Referring to FIGS. 5 and 6, when the pressing member 40 is depressed down during wire terminating operations, the stop edge 401 of the pressing member 40 will be releasably engaged with an upper flange 101 of the outer casing 10 so as to temporarily keep the pressing member 40 in a depressed position. At this stage, the lower end of both the pressing member 40 and the side legs 50 of the U-shaped member 50 abut upon the bottom side of the hollow section 11 in the outer casing 10 compressing the resilient element 20 in the first and second recesses 13 and 42. Consequently, the wire passages 41, the oblique guide channels 51, the wire guide openings 31 and the wire grooves 12, all align with each other in communication, as shown in FIG. 5, is that electrical wire strands can be conveniently inserted from the wire passages 41 down through to the bottom of the wire grooves 12, as shown by the arrow line in FIG. 5.

As can be seen in FIG. 5, when the pressing member is kept in a depressed position, a space S is defined between the U-shaped member 50 and the top side of the second recess 42. This space S corresponds to the vertical distance S' defined between the wire pressing point 511 of the two oblique channels 51 and the wire bending point 431 of the two wire bending blocks 43. Theoretically, the larger the vertical distance S', the more effective in wire terminating operation, due to the fact that the larger the vertical distance S', the greater the number of wire strands that can be easily passed therethrough. (Of course, the wire guide openings 31 of the metal conductors 30 will have to be enlarged as well.) Therefore, the wire strands (large or small) of an electrical cord can be easily inserted into the wire grooves 12. After the electrical cord is inserted into the wire passages 41 and the wire strands reach down to the wire grooves 12, just pushing upon the pressing member 40 once, the stop edge 401 of the pressing member 40 will be disengaged with the upper flange 101, and the compressed resilient element 20 will push the pressing member 40 upward until the shoulder of the pressing member 40 impinges upon the upper flange 101 of the outer casing 10. It is to be noted that in the initial stage when the pressing member 40 is being pushed upward by the resilient element 20, the sliding member 50 remains unmoved there at until the pressing member 40 moves up to a distance equal to the distance S, whereupon both the pressing member 40 and the U-shaped member 50 are moved up together at the same level. Therefore, in the initial upward movement, the wire-bending points 431 of the pressing member 40 will first press the front portion of the inserted wire strands so that they bend against one upper side of each metal conductor 30 and continue to move upward, and, on being moved to a distance S, the wire-pressing points 511 of the oblique guide channels 51 begin to press the rear portion of the inserted wire strands to bend against the other upper side of each metal conductor 30 and then, both the wire pressing points 511 and the wire-bending points 431 are moved up together at the same level. As a result, the inserted wire strands in the wire guide openings 31 are respectively pressed so as to bend closely against the upper opposing sides of each metal conductor 30 and be firmly secured there at.

It shall be appreciated that, with the arrangement of the sliding member 50, when the pressing member 40 is depressed and being held at the stop edge 401, as shown in FIG. 5, and already for wire termination operations, the vertical distance S' between the wire-pressing points 511 of the U-shaped member 50 and the wirebending points 431 of the pressing member 40 reaches a maximum distance (the larger the better); while, the pressing member 40 and the U-shaped sliding member 50 are moved up, completing the wire termination operation, when the wire pressing points 511 and the wire bending points 431 are located at the same level (i.e. $S'=0$), resulting in the wire strands being tightly secured in position.

The foregoing is considered as illustrative only of the principles of the present invention. Furthermore, since numerous modifications and changes will readily occur to those skilled in the art, it is not desired to limit the invention to the exact construction and operation shown and described, and accordingly all suitable modifications and equivalents may be resorted to which fall within the scope of the present invention as claimed.

What is claimed is:

1. An improved push-type wire terminating apparatus having an outer casing formed with an upper flange, a plurality of wire grooves, a first recess in a middle portion thereof with a resilient element disposed therein, an upper hollow section with a plurality of metal conductors fixed therein, a pressing member formed with wire passages, wire-bending points, an open section and a second recess thereof movably disposed in the upper hollow section of the outer casing, comprising:

a U-shaped sliding means having a plurality of oblique guide channels separately provided in an upper portion thereof movably installed in the open section of the pressing member in an inverse position over the second recess thereof;

such that when the pressing member is pressed down for wire termination operations, the wire passages of the pressing member and said oblique guide channels of said sliding means will be respectively aligned with the wire guide openings of the metal conductors and the wire grooves of the outer casing.

2. The improved push-type wire terminating apparatus according to claim 1, wherein said U-shaped sliding means further includes a wire-pressing point formed at a lower end of each said oblique guide channel and located close to another upper side of each metal conductor for the purpose of firmly securing wire strands thereat against the upper portion of each metal conductor in connection with the pressing member and the wire-bending points.

3. The improved push-type wire terminating apparatus according to claim 1, wherein said U-shaped sliding means further includes at least two side legs each with a predetermined length, separately extending downward between said second recess of the pressing member and the upper portion of each metal conductor so that, when the pressing member is depressed, a maximum vertical distance will be present between the wire-bending points of the pressing member and said wire-pressing points of said U-shaped sliding means for facilitating wire strand insertion operations; such that when said pressing member is moved up, said maximum vertical distance will be reduced to zero so as to firmly secure the wire strands in position against the upper portion of each metal conductor.

* * * * *